US008708041B2

(12) United States Patent
Villegas et al.

(10) Patent No.: US 8,708,041 B2
(45) Date of Patent: Apr. 29, 2014

(54) METHOD AND SYSTEM FOR USING WIRELINE CONFIGURABLE WELLBORE INSTRUMENTS WITH A WIRED PIPE STRING

(75) Inventors: Laurent Villegas, Houston, TX (US); Christopher S. Del Campo, Houston, TX (US); Shyam B. Mehta, Missouri City, TX (US); Reza Taherian, Sugar Land, TX (US); Jean-Marc Follini, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 96 days.

(21) Appl. No.: 12/544,325

(22) Filed: Aug. 20, 2009

(65) Prior Publication Data

US 2011/0042072 A1 Feb. 24, 2011

(51) Int. Cl.
*E21B 47/00* (2012.01)

(52) U.S. Cl.
USPC ..... 166/254.2; 166/385

(58) Field of Classification Search
USPC ..... 166/254.2, 385; 73/152.02, 152.03
See application file for complete search history.

(56) References Cited

U.S. PATENT DOCUMENTS

| | | | | |
|---|---|---|---|---|
| 4,806,928 | A | 2/1989 | Veneruso | |
| 5,295,548 | A * | 3/1994 | Yuasa et al. | 175/40 |
| 5,433,276 | A * | 7/1995 | Martain et al. | 166/384 |
| 5,521,592 | A | 5/1996 | Veneruso | |
| 6,092,416 | A | 7/2000 | Halford et al. | |
| 6,419,013 | B1 * | 7/2002 | Milne et al. | 166/254.2 |
| 6,618,675 | B2 * | 9/2003 | Strickland | 702/6 |
| 6,641,434 | B2 | 11/2003 | Boyle et al. | |
| 6,866,306 | B2 | 3/2005 | Boyle et al. | |
| 7,134,493 | B2 * | 11/2006 | Runia | 166/254.2 |
| 7,385,523 | B2 * | 6/2008 | Thomeer et al. | 340/854.8 |
| 7,389,183 | B2 * | 6/2008 | Gray | 702/6 |
| 7,537,061 | B2 * | 5/2009 | Hall et al. | 166/385 |
| 2006/0225926 | A1 | 10/2006 | Madhavan et al. | |
| 2008/0066905 | A1 * | 3/2008 | Aivalis et al. | 166/250.01 |

* cited by examiner

*Primary Examiner* — Shane Bomar
*Assistant Examiner* — Kipp Wallace
(74) *Attorney, Agent, or Firm* — Mark D. Shelley, II; Kimberly Ballew

(57) ABSTRACT

A wellbore instrument system includes a pipe string extending from earth's surface into a wellbore. At least a portion of the pipe string includes a signal communication channel having a cable, such as an electrical conductor or an optical fiber. At least one wireline configurable wellbore instrument is coupled to the pipe string and has at least one sensor therein for measuring a physical parameter. The at least one instrument is in signal communication with the signal communication channel in the pipe string. The system includes a controller functionally associated with the at least one instrument and configured to initiate operation of the at least one sensor upon detection of a command signal.

23 Claims, 4 Drawing Sheets

METHOD AND SYSTEM FOR USING WIRELINE CONFIGURABLE WELLBORE INSTRUMENTS WITH A WIRED PIPE STRING

The present application is a continuation-in-part application and claims priority from U.S. patent application Ser. No. 12/543,575, entitled "Method and System for Using Wireline Configurable Wellbore Instruments With a Wired Pipe String," filed on Aug. 19, 2009, which is hereby incorporated by reference in its entirety.

BACKGROUND OF THE INVENTION

1. Field of the Invention

The invention relates generally to the field of wellbore instruments and well logging methods. More specifically, the invention relates to systems and methods for operating electrically powered instruments in a well using a wired pipe string as a signal communication channel.

2. Background Art

Well logging instruments are devices configured to move through a wellbore drilled through subsurface rock formations. Well logging instruments include one or more sensors and other devices that measure various properties of the subsurface rock formations and/or perform certain mechanical acts on the formations, such as drilling or percussively obtaining samples of the rock formations and withdrawing samples of connate fluid from the rock formations. Measurements of the properties of the rock formations made by the sensors may be recorded with respect to the instrument axial position (depth) within the wellbore as the instrument is moved along the wellbore. Such recording is referred to as a "well log."

Well logging instruments can be conveyed along the wellbore by extending and withdrawing an armored electrical cable ("wireline"), wherein the instruments are coupled to the end of the wireline. Extending and withdrawing the wireline may be performed using a winch or similar spooling device known in the art. However, such conveyance relies on gravity to move the instruments into the wellbore, which can only be used on substantially vertical wellbores. Those wellbores deviating from vertical require additional force to move through the wellbore.

There are several types of wireline instrument conveyance known in the art for the foregoing conditions. One conveyance technique includes coupling the wireline instruments to the end of a coiled tubing having a wireline disposed therein. The wireline instruments are extended into and withdrawn from the wellbore by extending and retracting the coiled tubing, respectively. A subset of such coiled tubing techniques includes preliminary conveyance of the wireline configurable well logging instruments to a selected depth in the wellbore. See, for example, U.S. Pat. No. 5,433,276 issued to Martain et al. However, the use of coiled tubing with wireline instruments is costly and is inherently limited by the amount of pushing force capable with the coiled tubing. As a result, the use of coiled tubing is typically problematic in extended reach wells.

Another well logging instrument conveyance technique includes coupling wireline instruments to the end of a drill pipe or similar threadedly coupled pipe string. A wireline is coupled to the instruments using a "side entry sub" which provides a sealable passage from the exterior of the pipe string to the interior thereof. As the pipe string is extended into the wellbore, the wireline is extended by operating a conventional winch. An example of the foregoing is described in U.S. Pat. No. 6,092,416 issued to Halford et al. and assigned to the assignee of the present invention. However, this conveyance technique is frequently unreliable as the wireline is positioned in the annulus and subject to crushing, splicing or other damage. For example, the wireline may become pinched between the drill pipe and the casing or wellbore. Another drawback to using drill pipe to convey the well logging instruments using procedures known in the art is that the cable disposed outside the pipe disturbs the operation of the sealing equipment and makes it difficult to seal the drill pipe to maintain fluid pressure.

Additionally, the well logging instruments may be positioned at the end of a drill pipe without use of a wireline cable. In such circumstances, each well logging instrument is provided with a battery and memory to store the acquired data. As a result, the well logging instruments cannot communicate with the surface while downhole. Therefore, the data acquired cannot be analyzed at the surface until the wireline instruments return to the surface. Without any communication with the surface, surface operators cannot be certain the instruments are operating correctly, cannot control the instruments while downhole, and the data cannot be analyzed until after the wireline instruments are removed from the wellbore.

Recently, a type of drill pipe has been developed that includes a signal communication channel. See, for example, U.S. Pat. No. 6,641,434 issued to Boyle et al. and assigned to the assignee of the present invention. Such drill pipe has in particular provided substantially increased signal telemetry speed for use with downhole tools, such as logging while drilling ("LWD") instruments or measuring while drilling ("MWD"), over conventional signal telemetry, which typically is performed by mud pressure modulation or by very low frequency electromagnetic signal transmission.

It is also desirable to use wireline instruments in conjunction with the above mentioned wired drill pipe for a number of reasons. An important reason is to be able to convey the wireline instruments into wellbores having conditions making wireline conveyance impractical, while at the same time having sufficient telemetry bandwidth so that the signals generated by the wireline instruments may be monitored substantially in real time during operation thereof. It is also desirable to be able to control certain functions of the wireline instruments from the surface. Such functionality may not be practical using conventional drill pipe instrument conveyance of the type described in the Halford et al. '416 patent cited above unless the wireline is present in the well logging system. Deployment of the wireline in conjunction with using drill pipe can make the overall well logging procedure complex and difficult to perform. There exists a need, therefore, for wireline instruments to be operated using wired pipe strings for data and command communication.

DETAILED DESCRIPTION

Generally, the invention relates to devices for conveying a wireline configurable well logging instrument or a "string" of such instruments through a wellbore using a "wired" pipe string for conveyance and signal communication. While the present invention is described as used with tools commonly conveyed on a wireline ("wireline configurable well logging instruments"), the invention may be implemented with any other type of downhole tools, such as LWD tools, MWD tools, and sensors. The wired pipe string in some examples may include an adapter module or "sub" for coupling the well logging instrument or string thereof to the pipe string and for providing a signal coupling between a signal communication channel in the wired pipe string and the wireline configurable well logging instruments or string thereof. The wired pipe string may be assembled and disassembled in segments to effect conveyance in a manner known in the art for conveyance of segmented pipe through a wellbore.

Figure 1:
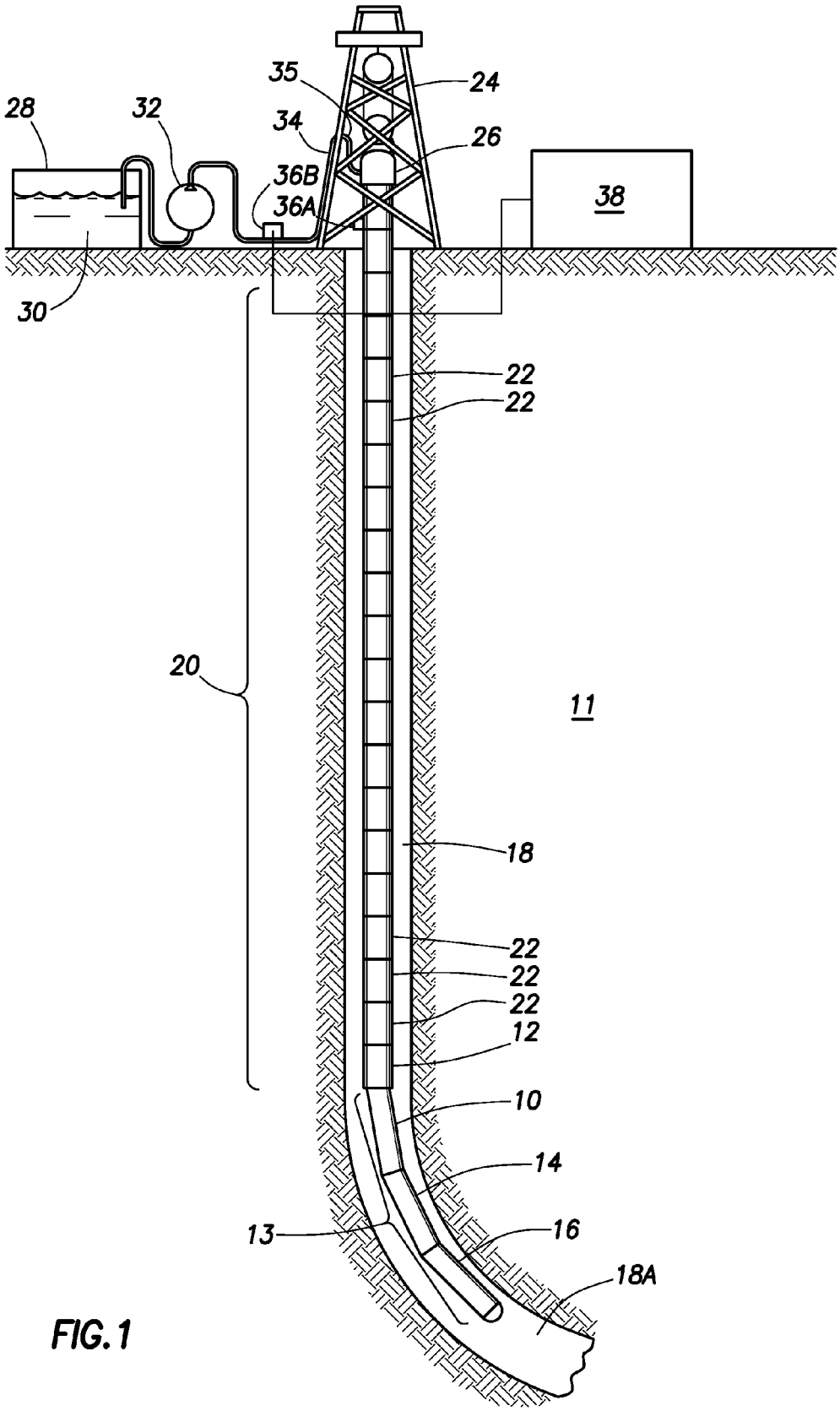
FIG. 1 shows an example of "wireline configurable" well logging instruments conveyed through a wellbore using a wired pipe string.

In FIG. 1, a drilling rig 24 or similar lifting device moves a conduit or pipe called a drill string 20 within a wellbore 18 that has been drilled through subsurface rock formations, shown generally at 11. The drill string 20 may be extended into the wellbore 18 by threadedly coupling together end to end a number of segments ("joints") 22 of drill pipe. The drill string 20 may comprise a portion of wired drill pipe, which may be structurally similar to ordinary drill pipe with a cable joined at each pipe joint. For example, the cable may be an electrical conductor, an optical fiber, or other cable capable of transmitting data. The cable may provide a signal communication channel along the drill string 20 for transmitting data associated with the wellbore 18, the formation surrounding the wellbore 18 and/or the drill string 20. The signal communication channel may extend within an interior of the drill pipe and into a shoulder of the drill pipe at each of the threads. Wired drill pipe also includes some form of signal coupling to communicate signals between pipe joints when the pipe joints are coupled end to end as shown in FIG. 1. See, as a non-limiting example, U.S. Pat. No. 6,641,434, which is hereby incorporated by reference, issued to Boyle et al. and assigned to the assignee of the present invention for a description of a type of wired drill pipe that can be used for the drill string 20 in the present invention. A person having ordinary skill in the art will appreciate that other constructions of a wired drill pipe are within the scope of the present invention. In an embodiment, the drill string 20 may comprise a portion of wired drill pipe and a portion of non-wired drill pipe. In such an embodiment, signals or data transmitted via the wired drill pipe may be transmitted along the non-wired drill pipe by a conventional telemetry system, such as mud pulse telemetry, acoustic telemetry or electromagnetic telemetry. The drill string 20 may hereinafter be referred to as "the wired pipe string 20" which should be interpreted as a drill string having a portion of wired drill pipe.

The wired pipe string 20 may include an assembly or "string" 13 of well logging instruments coupled a the lower end thereof. The well logging instrument string 13 may be coupled to the pipe string 20 using an adapter sub 12 which will be explained in more detail below with reference to FIGS. 2 and 3. In the present example, the well logging instrument string 13 may include what may be referred to as "wireline configurable" well logging instruments, shown individually at 10, 14 and 16. As used in the present description, the term "wireline configurable well logging instruments", whether individually or with reference to the string 13 of such instruments, means one or more well logging instruments that can be conveyed through a wellbore using armored electrical cable ("wireline"), and which cannot be used in a pipe string for conducting drilling operations as a part of the pipe string. Wireline configurable well logging instruments are thus distinguishable from "logging while drilling" ("LWD") instruments, which are configurable to be used during drilling operations and generally form part of the pipe string itself. The wireline configurable well logging instruments 13 may include tools for measuring characteristics of the formation, such as electrical properties, sonic properties, active and passive nuclear properties, dimensional properties of the wellbore, formation fluid sampling, formation pressure measurement, coring sample measurements and the like. The purpose for coupling the wireline configurable well logging instrument string 13 to the end of the wired pipe string 20 and the manner in which such devices are operated will be further explained below.

Several of the components disposed proximate the drilling unit 24 may be used to operate part of the system of the invention. These components will be explained with respect to their uses in drilling the wellbore to better enable understanding the invention. The wired pipe string 20 may be used to turn and axially urge a drill bit (not shown) into the bottom of the wellbore 18 to increase its length (depth). During drilling of the wellbore 18, at a time when the instrument string 13 may not be coupled to the wired pipe string 20, a pump 32 lifts drilling fluid ("mud") 30 from a tank 28 or pit and discharges the mud 30 under pressure through a standpipe 34 and flexible conduit 35 or hose, through the top drive 26 and into an interior passage (not shown separately in FIG. 1) inside the pipe string 20. The mud 30 exits the wired pipe string 20 through courses or nozzles (not shown separately) in the drill bit (not shown), where it then cools and lubricates the drill bit and lifts drill cuttings generated by the drill bit (not shown) to the Earth's surface. Flow of the drilling fluid 30 may also be used to deploy and retract the instrument string 13 with respect to the adapter sub 12 as will be further explained below.

When the wellbore 18 has been drilled to a selected depth, the wired pipe string 20 may be withdrawn from the wellbore 18, and the adapter sub 12 and the well logging instrument string 13 may be coupled to the end of the wired pipe string 20. The wired pipe string 20 may then be reinserted into the wellbore 18 so that the well logging instrument string 13 may be moved through, for example, a highly inclined portion 18A of the wellbore 18 which would be difficult or impossible to traverse using armored electrical cable ("wireline") to move the well logging instrument string 13. In one example, the well logging instrument string 13 may then be deployed from the adapter sub 12 and the pipe string 20 may be withdrawn from the wellbore 18 while various sensors (not shown separately) in the well logging instruments 10, 14, 16 make measurements of various physical parameters.

As the well logging instrument string 13 is moved along the wellbore 18 by moving the wired pipe string 20 as explained above, signals detected by various sensors, non-limiting examples of which may include an induction resistivity instrument disposed in logging instrument 16, a gamma ray sensor disposed in instrument 14 and a formation fluid sample taking device disposed in instrument 10 (which may include a fluid pressure sensor (not shown separately)) are selected to be included in a telemetry transceiver (explained below with reference to FIG. 3) in the adapter sub 12 for communication along the signal channel in the wired pipe string 20. A the surface, a telemetry transmitter 36A can be used to wirelessly transmit signals from the wired pipe string 20 to a receiver 36B. Thus, the wired pipe string 20 may be freely moved, assembled, disassembled and rotated without the need to make or break a wired electrical or optical signal connection. Signals from the receiver 36B, which may be electrical and/or optical signals, for example, may be conducted (such as by wire or cable) to a recording unit 38 for decoding and interpretation using techniques well known in the art. The decoded signals typically correspond to the measurements made by one or more of the sensors (not shown separately in FIG. 1) in the well logging instruments 10, 14, 16. Other well logging sensors known in the art that may be included in one or more of the well logging instruments 10, 14, 16 include, without limitation, density sensors, photoelectric effect sensors, neutron porosity sensors, neutron capture cross section sensors, acoustic travel time or velocity sensors, seismic sensors, neutron induced gamma spectroscopy sensors and microresistivity (resistivity imaging) sensors.

The functions performed by the adapter sub 12 may include providing a mechanical coupling (explained below with reference to FIG. 2) between the lowermost threaded connection on the wired pipe string 20 and the well logging instrument string 13. The adapter sub 12 may also include signal processing and recording devices (explained below with reference to FIG. 3) for selecting certain signals from the well logging instrument 13 for transmission to the surface (e.g., to the recording unit 38) using the wired pipe string 20 and for recording certain signals from the well logging instrument string 13 in a suitable data storage or recording device (explained below with reference to FIG. 3). Such signal processing devices (explained below) may also be used to communicate signals transmitted from the earth's surface, e.g., from the recording unit 38, to the well logging instrument string 13, for example, certain operating commands for the well logging instrument string 13 as will be further explained below.

It will be appreciated by those skilled in the art that in other examples the top drive 26 may be substituted by a swivel, kelly, kelly bushing and rotary table (none shown in FIG. 1) for rotating the pipe string 20 while providing a pressure sealed passage through the pipe string 20 for the mud 30. Accordingly, the invention is not limited in scope to use with top drive drilling systems.

Figure 2:
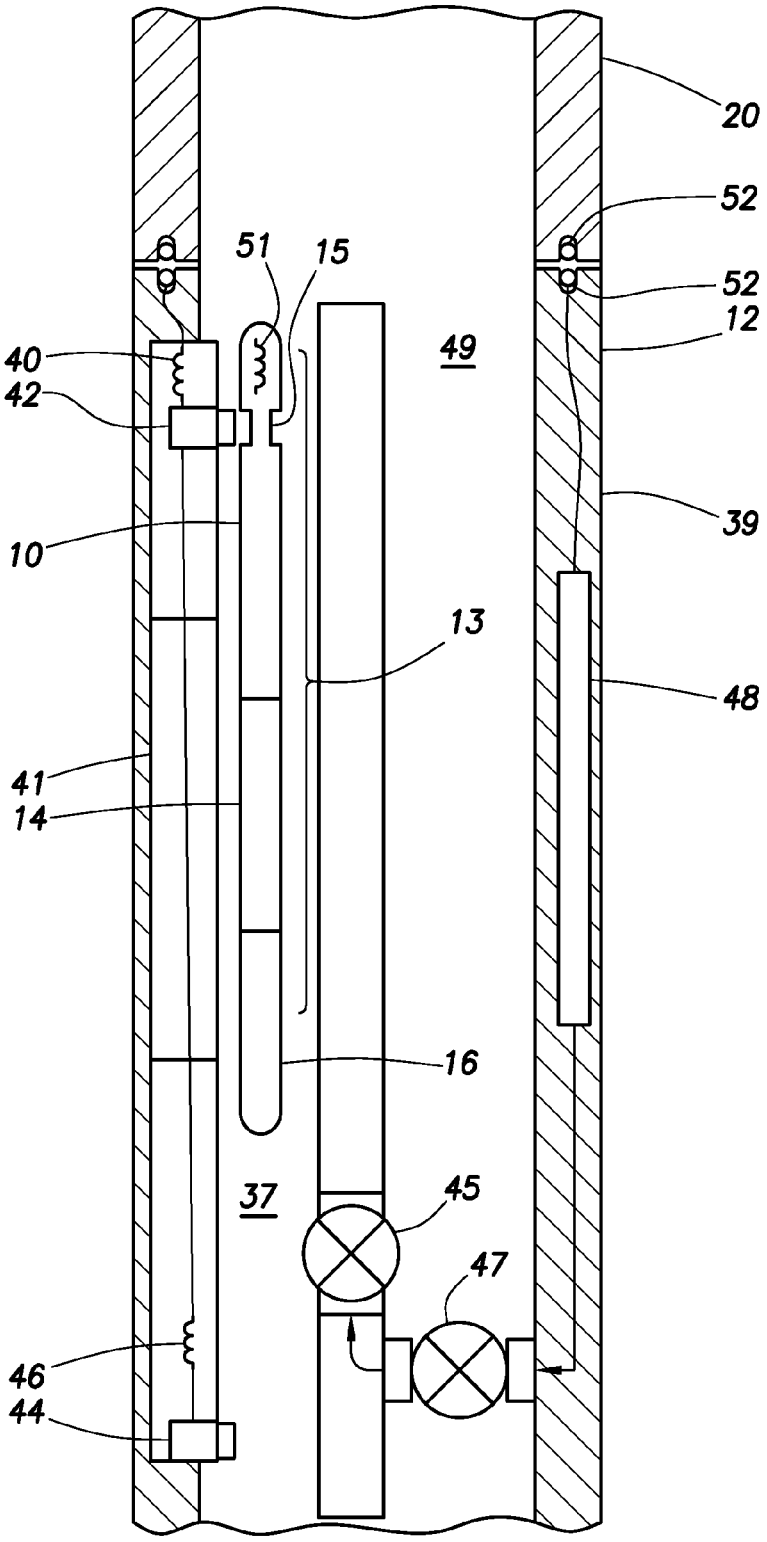
FIG. 2 shows an example of an adapter sub.

One example of the adapter sub 12 is shown in more detail in FIG. 2. The adapter sub 12 may include a generally cylindrically shaped housing 39 that is configured to threadedly couple at one end to the lower end of the wired pipe string 20. The wired pipe string 20 is shown as having a communication device 52 disposed in a thread shoulder thereof. The communication device 52 is configured to communicate signals to and from a corresponding communication device 52 disposed in a thread shoulder in an adjacent pipe joint (e.g., 22 in FIG. 1), or as shown in FIG. 2, in the adapter sub 12. A non-limiting example of such communication devices is described in U.S. Patent Application Publication No. 2006/0225926 filed by Madhavan et al., the underlying patent application for which is assigned to the assignee of the present invention.

In the present example, signal communication may be established through the communication device 52 in the adapter sub 12 to two example devices associated with the adapter sub 12. One such device can be a valve controller 48. The valve controller 48 may be disposed in a suitable enclosure (not shown) within the housing 39 and can be configured to detect certain command signals transmitted from the earth's surface (e.g., from the recording unit 38 in FIG. 1) to operate a valve system including one or more electrically operable valves 45, 47 disposed in the housing 39. The valve system (e.g., valves 45, 47) depending on their respective positions, establish a selected flow path for the drilling fluid (30 in FIG. 1) through the interior of the housing 39 to enable extension or retraction of the well logging instrument string 13 from the interior of the housing 39. The instrument string 13 is shown in its retracted position in FIG. 2. Operation of the valve system (e.g., valves 45, 47) will be further explained below. The other example device that can be in signal communication with the communication device 52 in the adapter sub 12 is a signal processing and telemetry unit 41. The signal processing and telemetry unit 41 may also be disposed in a suitable enclosure (not shown separately) within the housing 39 and may have associated therewith a first electromagnetic communication link 40 and a second electromagnetic communication link 46. The signal processing and telemetry unit 41 may also have associated therewith, and may be configured to control operation of, an upper latch 42 and a lower latch 44. Operation of the foregoing devices associated with the signal processing and telemetry unit 41 will be further explained below.

The first 40 and second 46 electromagnetic communication links are configured to establish signal communication between the signal processing and telemetry unit 41 (which itself is in signal communication with the recording unit [38 in FIG. 1] using the wired pipe string [20 in FIG. 1]) and the well logging instrument string 13. Such communication may be established using a corresponding electromagnetic communication link 51 disposed at a selected position within the well logging instrument string 13 proximate the first communication link 40 or the second communication link 46. As shown in FIG. 2, the first communication link 40 is disposed proximate the corresponding communication link 51 when the well logging instrument string 13 is in its withdrawn position inside the housing 39.

Typically, although not exclusively, the well logging instrument string 13 will be disposed in the withdrawn position during movement of the pipe string (20 in FIG. 1) through the wellbore (18 in FIG. 1) until a selected depth is reached. The well logging instrument string 13 may then be extended from the interior of the housing 39 so that well logging operations can be performed. In the present example, such extension may be performed as follows. A signal may be transmitted from the surface, e.g., from the recording unit (38 in FIG. 1) to the telemetry and signal processing unit 41 to cause release of the upper latch 42. The upper latch 42 may be, for example, a key associated with a spring loaded solenoid (neither shown separately), wherein the key (not shown separately) cooperates with a groove 15 in the exterior of one of the well logging instruments (e.g., the instrument 10) to retain the instrument string 13 in position inside the housing 39 until the upper latch 42 is released. Other types of latch will occur to those skilled in the art. A signal may also be communicated from the surface to the valve controller 48 to cause operation of the valve system, e.g., to close both valves 45, 47. Such operation of the valve system (e.g., valves 45, 47) will substantially prevent flow of drilling fluid (30 in FIG. 1) through a first passage 49 in the adapter sub 12. The pump (32 in FIG. 1) may then be operated to move drilling fluid (30 in FIG. 1). The drilling fluid (30 in FIG. 1) will be constrained by the valve system (e.g., closed valves 45, 47) to move through a second passage 37 in the housing 39 in which the instrument string 13 is disposed. Such fluid movement may cause the instrument string 13 to move longitudinally out of the housing 39 until the groove 15 engages the lower latch 44, thus preventing further movement of the instrument string.

When the instrument string 13 is in such position, the corresponding communication link 51 will be disposed proximate the second communication link 46 for establishing signal communication during well logging operations. A non-limiting example of an electromagnetic device that may be used for the communication links 51, 40 and 46, namely, an inductive coupling or coupler, is described in U.S. Pat. Nos. 5,521,592 and 4,806,928 issued to Veneruso; and U.S. Pat. No. 6,641,434 issued to Boyle et al., each of which is assigned to the assignee of the present invention and hereby incorporated by reference in its entirety. A flux coupling or coupler may be used as described in U.S. Pat. No. 6,866,306, which is assigned to the assignee of the present invention and hereby incorporated by reference in its entirety.

If it becomes necessary or desirable to withdraw the instrument string 13 back into the interior of the housing 39, such operation may be performed by transmitting a signal to the valve controller 48 to cause suitable operation of the valve system (e.g., valve 47 to close and valve 45 to open). For example, the signal may be transmitted from the surface, such as from the recording unit (38 in FIG. 1) or may be transmitted from a downhole component. When the drilling fluid (30 in FIG. 1) is pumped as explained above with the valve system components in suitable positions, the drilling fluid (30 in FIG. 1) may move into the second passage 37 wherein the well logging instrument string 13 is disposed. Such fluid movement may be directed such that the well logging instrument string 13 is pumped back into the interior of the housing 39 after the lower latch 44 is released. Alternatively, the lower latch 44 may be self-releasing in one direction to enable movement of the instrument string 13 into the interior of the housing 39 without the need to operate the lower latch 44. A possible advantage of using such valve configuration for fluid flow redirection is that it can eliminate the need to pump the drilling fluid (30 in FIG. 1) in a reverse direction (i.e., into the wellbore [18 in FIG. 1]) in order to cause the well logging instrument string 13 to retract into the housing 39.

The digital data handling rate (bandwidth) of typical wired pipe strings, such as the one described in the Boyle et al. patent, is about 1 million bits per second. As is known in the art, typical wireline configurable well logging instrument strings can generate signal data at large multiples of the bandwidth of typical wired pipe strings. Accordingly, it is desirable to use the available wired pipe string (20 in FIG. 1) bandwidth to communicate to the surface those signals from the well logging instrument string (13 in FIG. 1) that are most valuable to obtain substantially as they are measured (in "real time"). Other data that are not typically valuable to obtain in real time, for example, instrument diagnostic measurements, may be stored in a local data storage device. It is also desirable to be able to change the particular signals transmitted to the surface in real time, as well as to change the sample rate of such real time transmission. For example, certain well logging measurements, such as induction resistivity corresponding to large lateral distance from the wellbore, change relatively slowly with change in axial position of the well logging instrument string. It may be possible to send such measurements to the surface at relatively slow rates (e.g., 1-100 Hz), while measurements that change more rapidly (e.g. microresistivity measurements made for wellbore imaging) may be transmitted at much higher rates (e.g., 1 KHz to 1000 KHz).

Figure 3:
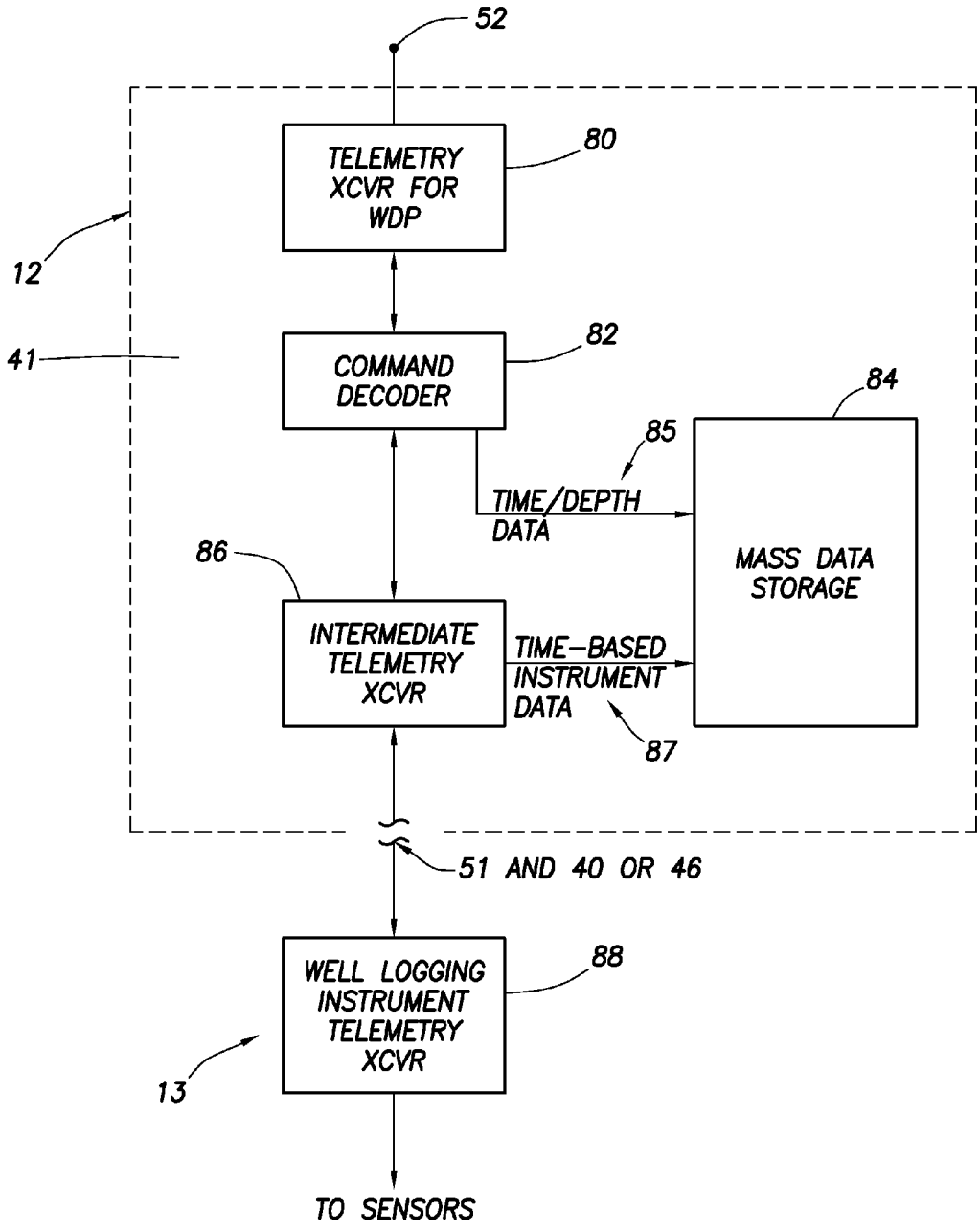
FIG. 3 shows an example telemetry unit for an adapter sub or wireline instrument.

An example of the signal processing and telemetry unit 41 that can perform the foregoing telemetry conversion and formatting and localized data storage is shown in block diagram form in FIG. 3. The communication device 52 (also shown FIG. 2) in that couples signals to the signal communication channel in the wired pipe string is in signal communication with a telemetry transceiver 80 ("WDP transceiver") configured to communicate signals in the telemetry format used for the wired pipe string (20 in FIG. 1). The WDP transceiver 80 is preferably bidirectional. A command decoder 82 may interrogate the telemetry signals from the WDP transceiver 80 to detect any commands originating from the recording unit (38 in FIG. 1). Such commands may include as explained above, commands to release the upper latch (42 in FIG. 2), and to operate the valve system (e.g., valves 45, 47 in FIG. 2). Commands may also include instructions to send different instrument measurement signals from the well logging instrument string (13 in FIG. 1) to the recording unit (38 in FIG. 1) over the wired pipe string (20 in FIG. 2). Another type of signal that may be detected in the command decoder 82 is time/depth records. As the pipe string (20 in FIG. 1) is moved along the wellbore (18 in FIG. 1), the axial position in the wellbore (18 in FIG. 1) of a reference point on the pipe string (20 in FIG. 1) or on the instrument string (13 in FIG. 1) may be used to indicate the depth of each instrument sensor (e.g., 10, 14, 16) in the instrument string (13 in FIG. 1). The depth is typically determined by measuring the elevation of the top drive (26 in FIG. 1) and adding to the elevation the length of all the individual components of the pipe string (20 in FIG. 1) and the instrument string (13 in FIG. 1). The elevation may be recorded automatically in the recording unit (38 in FIG. 1) by use of appropriate sensors on the drilling unit (24 in FIG. 1). The time/depth information may be used to generate a record with respect to depth of measurements made by the various sensors in the instrument string (13 in FIG. 1).

The command decoder 82 may transmit instructions to change the data sent over the wired pipe string (20 in FIG. 1) to an intermediate telemetry transceiver 86. The intermediate telemetry transceiver 86 receives well logging instrument measurements from the instrument string (13 in FIG. 1) by signal connection to a well logging instrument telemetry transceiver 88 in the instrument string 13. The signal communication, as explained with reference to FIG. 2 may be made between the corresponding communication link 51 and either the first 40 or second 46 communication links (shown by number only in FIG. 3). The well logging instrument telemetry transceiver 88 may be the same type as used in any wireline configurable well logging instrument string, and is preferably configured to transmit signals over an armored electrical cable ("wireline") when the well logging instrument string (13 in FIG. 1) is deployed on a wireline. In the present example, all well logging instrument signals that would be transmitted over a wireline if the instrument string (13 in FIG. 1) were so connected can be communicated from the wireline telemetry transceiver 88 to the intermediate telemetry transceiver 86. Depending on the instruction received from the surface (i.e., from the recording unit 38 in FIG. 1) some of the signals are communicated to the WDP telemetry transceiver 80 for communication over the wired pipe string (20 in FIG. 1). Those of the well logging instrument signals not transmitted over the wired pipe string (20 in FIG. 1) may be communicated to a mass data storage device 84 such as a solid state memory or hard drive. The mass data storage device 84 may also receive and store the same signals that are transmitted to the surface over the wired pipe string. The foregoing components, including the WDP telemetry 80, mass data storage 84, command decoder 82 and intermediate telemetry 86 may all be parts of the telemetry and signal processing unit 41 in some examples. In other examples, the foregoing components may be enclosed in a separate housing (not shown) that is itself coupled to the adapter sub 12 and to the instrument string 13. Typically, the mass data storage device 84 will be interrogated by direct electrical or other connection to the recording unit (38 in FIG. 1) when the pipe string (20 in FIG. 1) is fully withdrawn to the earth's surface.

The WDP telemetry 80 may also detect clock or time signals transmitted from the recording unit (38 in FIG. 1) for the purpose of synchronizing electronic system operating clocks (e.g., in the well logging instrument telemetry transceiver 88) associated with the well logging instrument string (13 in FIG. 1). Another clock (not shown separately) that may be so synchronized may be associated with a signal processing unit explained below with reference to FIG. 4.

Figure 4:
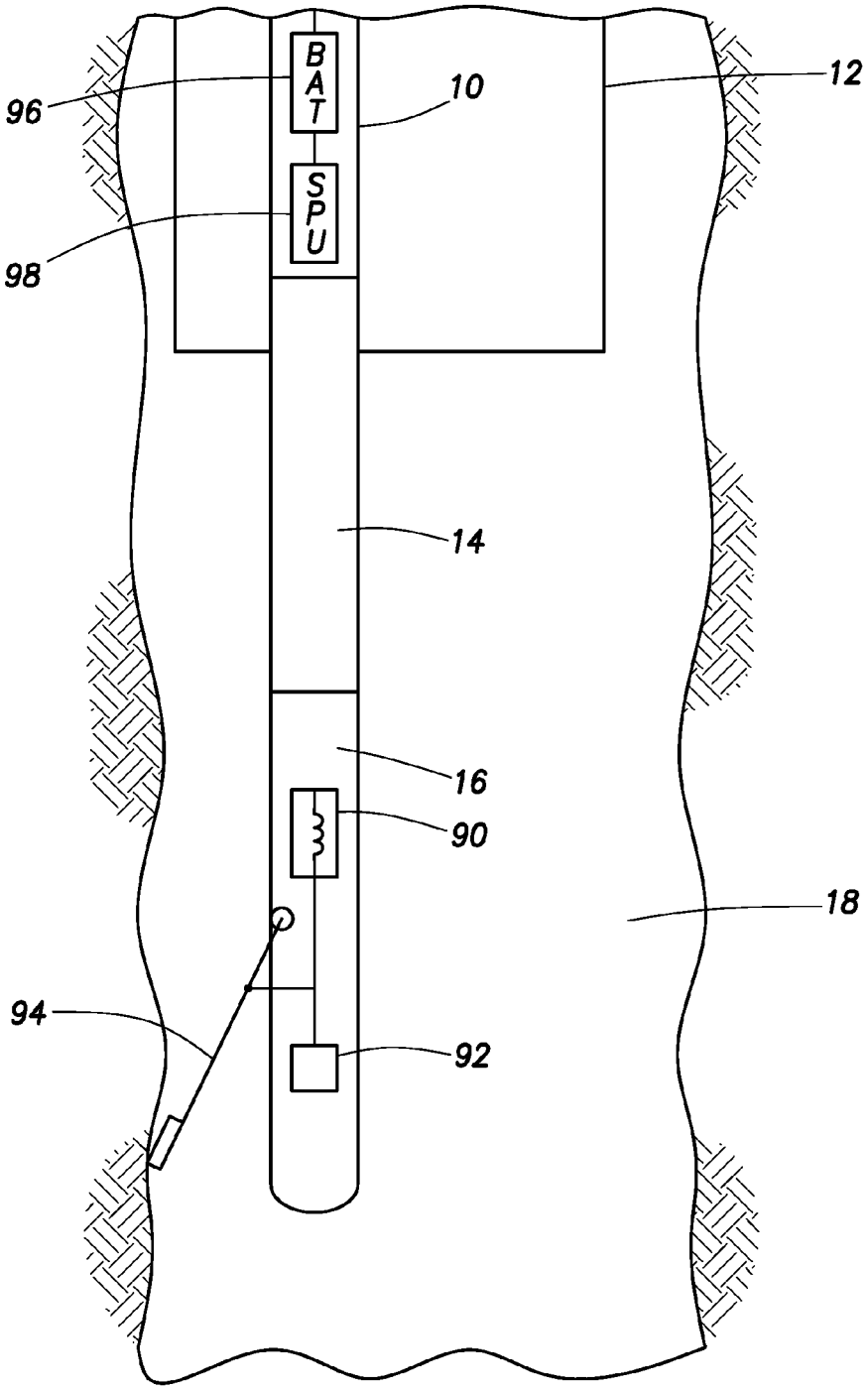
FIG. 4 shows an example of wireline instrument string deployed in a wellbore from the adapter sub shown in FIG. 2.

FIG. 4 shows an example of having the well logging instrument string (13 in FIG. 2) deployed from the adapter sub 12 explained with reference to FIG. 2. As explained above, the instrument string (13 in FIG. 2) may be engaged with the lower latch (44 in FIG. 2) so that it only partially extends into the open wellbore 18 below the adapter sub 12. The various well logging sensors (not shown separately) in the well logging instruments 10, 14, 16 may make measurements of various petrophysical and other parameters, some of which may be transmitted to the recording unit (38 in FIG. 1) substantially in real time as explained with reference to FIG. 3. Typically, the wired pipe string (20 in FIG. 1) will be withdrawn from the wellbore 18 to cause the well logging instruments 10, 14, 16 to move along the interior of the wellbore 18 while the foregoing measurements are made.

FIG. 4 shows particular elements of one of the logging instruments 10 to explain another aspect of the present invention. In some examples, the well logging instruments 10, 14, 16 may obtain electrical power for their operation from a battery 96 or similar energy storage device. It will be appreciated by those skilled in the art that electrical power from the battery 96 may in some examples be supplemented, and/or the battery may be recharged by addition of a fluid operated turbine and electric generator (neither shown in the figures) for times when the pump (32 in FIG. 1) is operating to move fluid (30 in FIG. 1) through the wired pipe string (20 in FIG. 1). The logging instrument 10 may include a signal processing unit 98 that is configured to activate the various sensors (not shown separately) in the well logging instruments 10, 14, 16 upon detection of a command signal, for example, a signal transmitted from the recording unit (38 in FIG. 1), or, for example, upon detection of communication between the corresponding communication link (51 in FIG. 2) and the second communication link (46 in FIG. 2) as indication that the instrument string (13 in FIG. 1) is suitably deployed from the adapter sub 12. The signal processing unit 98 may also be configured to switch off the sensors (not shown separately) when the instrument string (13 in FIG. 1) is fully withdrawn into the adapter sub 12. Such control may be performed, for example, by detection of communication between the corresponding communication link (51 in FIG. 2) and the first communication link (40 in FIG. 2). Alternatively, or in addition, the signal processing unit 98 may switch off the sensors (not shown separately) upon detection of a signal, such as may be transmitted from the surface by the recording unit (38 in FIG. 1).

One of the example well logging instruments shown in FIG. 4, for example the lowermost instrument 16 may include a contact arm type caliper sensor, consisting of a laterally extensible contact arm 94 that may be urged into contact by a spring or other biasing device such as an hydraulic cylinder, shown generally at 92. A sensor 90 such as a linear variable differential transformer or potentiometer may be linked to the contact arm 94 to respond to the amount of lateral extension of the arm 94. Thus, the sensor 90 generates signals corresponding to the diameter of the wellbore 18. The biasing device 92 may be in signal communication with the signal processing unit 98 so that the contact arm 94 is urged outward by the biasing device 92 upon detection of a suitable command signal. Such signal may be transmitted from the recording unit (38 in FIG. 1) or may be generated automatically by the telemetry and signal processing unit (41 in FIG. 2) in response to the longitudinal position off the instrument string (13 in FIG. 1) with respect to the adapter sub, i.e., whether the instrument string (13 in FIG. 1) is extended or withdrawn. The signal processing unit 98 may be configured to automatically cause the contact arm 94 to retract in the event of detection of a hazard in the wellbore 18, e.g., a change in pressure or temperature above a selected threshold or rate thereof, excessive tension on the well logging instrument string (13 in FIG. 1) or other hazard indication known in the art.

In some examples, signals transmitted to the recording unit (38 in FIG. 1) substantially in real time from the various well logging instruments 10, 14, 16 may be used to evaluate the quality of the information obtained from the various sensors (e.g., caliper sensor 90) in the instruments 10, 14, 16. If it is determined by such evaluation that some of the sensor signals are not of sufficient quality, the instrument string (13 in FIG. 1) may be withdrawn into the adapter sub 12 as explained with reference to FIG. 2, the pipe string (20 in FIG. 1) may be reinserted to a selected depth in the wellbore 18, for example, a depth at which it was determined the sensor signals became of insufficient quality. At such depth, the instrument string (13 in FIG. 1) may be redeployed as explained with reference to FIG. 2, and the measurement operation repeated over such section of the wellbore 18 as is deemed necessary to obtain sufficient quality sensor signals.

In other examples, certain instrument and/or sensor operating characteristics may be adjusted by transmission of a suitable command signal from the recording unit (38 in FIG. 1) to the signal processing unit 98. In one example, the time or depth sample rate of a sensor's (e.g., sensor 90) signal output may be increased or decreased. In another example, a signal measurement or operating frequency may be changed. Other examples of sensor operating characteristics that may be changed using commands transmitted from the recording unit (38 in FIG. 1) will occur to those skilled in the art.

The foregoing operations of wireline configurable well logging instruments are made possible at the end of a wired pipe string because of the relatively high bandwidth signal communication channel in the wired pipe string. Such operations may provide certain benefits over operating wireline configurable well logging instruments at the end of conventional, non-wired drill pipe, including initiating operation of the instrument sensors to conserve battery power, to initiate deployment and withdrawal of the instruments from an adapter used for protective conveyance, and to initiate operation of certain mechanical devices in the instruments, among other possible benefits.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wellbore instrument system, comprising:

a drill string extending from earth's surface into a wellbore comprising segments of drill pipe coupled together forming pipe joints and a signal communication channel coupled at a plurality of the pipe joints of the drill string wherein at least a portion of the drill string is wired drill pipe;

a well logging instrument string having at least one wireline configurable wellbore instrument coupled to the drill string and at least one sensor therein for measuring a physical parameter, the wireline configurable wellbore instrument in signal communication with the signal communication channel in the drill string wherein the wireline configurable wellbore instrument cannot be used for conducting drilling operations as a part of the drill string and may not be coupled to the drill string during drilling of the wellbore;

a controller functionally associated with the instrument string and configured to initiate operation of the at least one wireline configurable wellbore instrument upon detection of a command signal; and an adapter sub coupled to a lower end of the drill string, wherein the adapter sub provides a signal coupling between the signal communication channel and the at least one wireline configurable wellbore instrument, and wherein the adapter sub comprises one or more devices that detect and process signal commands, signal communications and data transmission between the at least one wireline configurable wellbore instrument and the earth's surface and wherein the adapter sub is operable to retain the at least one wireline configurable wellbore instrument in a longitudinal position partially extended from an end of the adapter sub.

2. The system of claim 1, wherein the adapter sub is operable to release the at least one instrument.

3. The system of claim 1 wherein the adapter sub comprises at least one electromagnetic communication link configured to enable signal communication between the at least one instrument and the signal communication channel.

4. The system of claim 1 wherein the adapter sub comprises two electromagnetic communication links positioned in the adapter sub such that the at least one instrument is in signal communication with the signal communication channel when the at least one instrument is retained within the adapter sub and when the instrument is extended at least partially from one end of the adapter sub.

5. The system of claim 1 further comprising a fluid flow control system configured to release or withdraw the instrument.

6. The system of claim 1 wherein the at least one instrument comprises a wellbore caliper, the caliper comprising a wellbore wall contact arm and a controllable biasing device functionally associated with the contact arm.

7. The system of claim 1 further comprising a battery associated with the at least one instrument to provide electrical power to operate the sensor, and wherein the controller is configured to cause the sensor to be powered by the battery upon detection of a command signal.

8. The system of claim 1 further comprising a data recording unit in signal communication with the communication channel at a surface end of the drill string, the data recording unit configured to detect and record signals transmitted over the communication channel from the at least one instrument.

9. The system of claim 8 herein the recording unit is configured to transmit the command signal.

10. A method for well logging, comprising:

moving a well logging instrument string having at least one wireline configurable well logging instrument along a wellbore to a selected position, the at least one instrument being disposed proximate one end of a drill string comprising segments of drill pipe coupled together and a signal communication channel associated therewith, wherein at least a portion of the drill string is wired drill pipe;

wirelessly transmitting a signal from the earth's surface to the at least one wireline configurable well logging instrument over the signal communication channel via an adapter sub coupled to the lower end of the drill string, and wherein the adapter sub comprises one or more devices that detect and process signal commands, signal communications, and data transmission between the at least one wireline configurable wellbore instrument and the earth's surface; and extending or withdrawing the at least one wireline configurable well logging instrument from the drill string in response to detection of the signal wherein the wireline configurable wellbore instrument cannot be used for conducting drilling operations as a part of the drill string and may not be coupled to the drill string during drilling of the wellbore.

11. The method of claim 10 further comprising:

retaining the at least one wireline configurable well logging instrument inside a part of the drill string during the moving;

transmitting a signal from the earth's surface over the communication channel to release a latch retaining the at least one wireline configurable well logging instrument inside the part of the drill string; and at least partially extending the at least one wireline configurable well logging instrument from an end of the drill string into the wellbore.

12. The method of claim 11 wherein the at least partially extending step comprises pumping fluid through the drill string.

13. The method of claim 10 further comprising withdrawing the at least one wireline configurable well logging instrument into the drill string by pumping fluid through the drill string.

14. The method of claim 13 wherein the pumping comprises operating a valve system to cause flow of the fluid to reverse direction proximate the at least one instrument.

15. The method of claim 11 further comprising initiating operation of the at least one sensor after extending the at least one wireline configurable well logging instrument from the drill string.

16. The method of claim 10 further comprising withdrawing the drill string from the wellbore while operating the at least one sensor, and communicating at least a portion of signals generated by the at least one sensor to the earth's surface over the communication channel.

17. The method of claim 16 further comprising:

identifying a portion of the wellbore from the at least a portion of the signals communicated to the earth's surface;

reinserting the drill string into the wellbore so that the at least one instrument moves adjacent to the identified portion; and withdrawing the drill string while operating the at least one sensor.

18. The method of claim 10 further comprising transmitting a control signal to the at least one instrument over the communication channel and adjusting at least one sensor operating parameter in response to the control signal.

19. The method of claim 18 wherein the at least one sensor operating parameter comprises at least one of time sample rate, depth sample rate and operating frequency.

20. The method of claim 10 further comprising initiating extension of a caliper contact arm in response to detection of the signal by the at least one instrument.

21. The method of claim 20 further comprising initiating retraction of the caliper contact arm in response to detection of a hazard in the wellbore.

22. The method of claim 21 wherein the initiating retraction is performed automatically by the at least one instrument in response to detection of a signal by a sensor therein.

23. The method of claim 10 further comprising transmitting a clock synchronization signal from the earth's surface to the at least one instrument to synchronize a clock in the at least one instrument with a clock at the earth's surface.

* * * * *